US006901860B2

(12) United States Patent
Ito

(10) Patent No.: US 6,901,860 B2
(45) Date of Patent: Jun. 7, 2005

(54) PRINTING MACHINE

(75) Inventor: Shinji Ito, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/689,590

(22) Filed: Oct. 22, 2003

(65) Prior Publication Data

US 2004/0089181 A1 May 13, 2004

(30) Foreign Application Priority Data

Nov. 11, 2002 (JP) ..... 2002-326208
Jul. 17, 2003 (JP) ..... 2003-198246

(51) Int. Cl.[7] ..... B41N 3/00
(52) U.S. Cl. ..... 101/463.1; 101/401.1; 101/465
(58) Field of Search ..... 101/401.1, 463.1, 101/465–467

(56) References Cited

U.S. PATENT DOCUMENTS 6,050,188 A 4/2000 Bolza-Schunemann
6,470,799 B2 * 10/2002 Nakazawa et al. ..... 101/466
6,502,509 B2 * 1/2003 Gottling et al. ..... 101/248
6,510,795 B1 1/2003 Detmers et al.
6,543,348 B2 * 4/2003 Onuma et al. ..... 101/142
6,668,720 B2 12/2003 Jentzsch
2002/0053295 A1 5/2002 Jentzsch

FOREIGN PATENT DOCUMENTS

EP 0 949 071 A1 10/1999
JP P2000-301689 A 10/2000
JP P2001-322233 A 11/2001
JP P2001-322234 A 11/2001
JP P2001-322235 A 11/2001
JP P2001-322238 A 11/2001
JP P2002-29023 A 1/2002

* cited by examiner

*Primary Examiner*—Andrew H. Hirshfeld
*Assistant Examiner*—Jill E. Culler
(74) *Attorney, Agent, or Firm*—McDermott Will & Emery LLP

(57) ABSTRACT

A recording head moving mechanism has a pair of guide rails fixed to a support member, and a ball screw extending parallel to the guide rails. The ball screw is rotatable by a motor to move a recording head parallel to an axis of a plate cylinder. At an image-recording time, the recording head records an image while being moved at a constant speed by the moving mechanism through a moving region between a recording start position and a recording finish position. After recording the image, the recording head is moved to a retreat position.

9 Claims, 8 Drawing Sheets

PRINTING MACHINE

BACKGROUND OF THE INVENTION

1. Field of the Invention

This invention relates to a printing machine for making a printing plate by recording and developing an image on the plate, and thereafter printing the image by feeding ink to the plate.

2. Description of the Related Art

In an ordinary conventional printing machine, a prepress process is carried out first to make a printing plate by exposing the plate placed in contact with a film having a binary black and white image recorded thereon. Then, the plate is loaded into a printing apparatus to carry out a printing process.

Recently, printing machines commonly called digital printers have been proposed, one such printer being capable of performing both the prepress process and printing process. A digital printer, as described in U.S. Pat. No. 6,050,188, for example, employs a "computer-to-plate" system for forming an image on a printing plate by directly scanning and exposing the plate with laser beams or the like modulated with image signals.

A printing machine as described in U.S. Pat. No. 6,050,188 has, arranged in the same space, plate cylinders for holding printing plates mounted peripherally thereof, blanket cylinders with blankets mounted peripherally thereof, an impression cylinder, image recorders for recording images on the printing plates mounted peripherally of the plate cylinders, and ink feeders for feeding inks to the printing plates mounted peripherally of the plate cylinders. A recording head is disposed close to each plate cylinder for recording images on the printing plate mounted peripherally of the plate cylinder.

In the printing machine capable of performing both the prepress process and printing process described above, the recording head is disposed around each plate cylinder even at a printing time. Mists and particles of the inks, water, paper and so on floating in the printing machine tend to adhere to the recording head, The quantity of light for recording could thereby be reduced to record defective images. This results in the inconvenience of having to clean the recording head periodically.

SUMMARY OF THE INVENTION

The object of this invention, therefore, is to provide a printing machine that minimizes adhesion to a recording head of inks, water, paper particles and so on, thereby to reduce the frequency of cleaning the recording head.

The above object is fulfilled, according to this invention, by a printing machine for recording an image on a printing plate, and printing the image by using the printing plate with the image recorded thereon, comprising a plate cylinder for supporting a printing plate as mounted peripherally thereof, an image recorder having a recording head movable along a surface of the plate cylinder in a direction parallel to an axis of rotation of the plate cylinder for recording an image on the printing plate mounted peripherally of the plate cylinder, an ink feeder for feeding ink to the printing plate mounted peripherally of the plate cylinder and having the image recorded by the image recorder, and a moving device, operable at a printing time, for moving the recording head to a retreat position sideways from a moving region where the recording head is moved at an image-recording time.

This printing machine, with the moving device operable at a printing time for moving the recording head to the retreat position sideways from the moving region where the recording head is moved at an image-recording time, can prevent adhesion to the recording head of inks, water, paper particles and so on. Thus, the frequency of cleaning the recording head may be reduced.

In one preferred embodiment, the printing machine has a shielding plate disposed between the moving region and the retreat position, and defining an opening for allowing passage of the recording head.

Preferably, the shielding plate is a side plate for rotatably supporting the plate cylinder.

In one preferred embodiment, the printing machine has a gas flow forming device for forming a gas flow directed from the retreat position toward the moving region.

Preferably, the gas flow forming device includes a chamber for enclosing the recording head moved to the retreat position, the chamber defining an opening opposed to the moving region for allowing passage of the recording head, and a fan for drawing a gas from outside the printing machine into the chamber.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
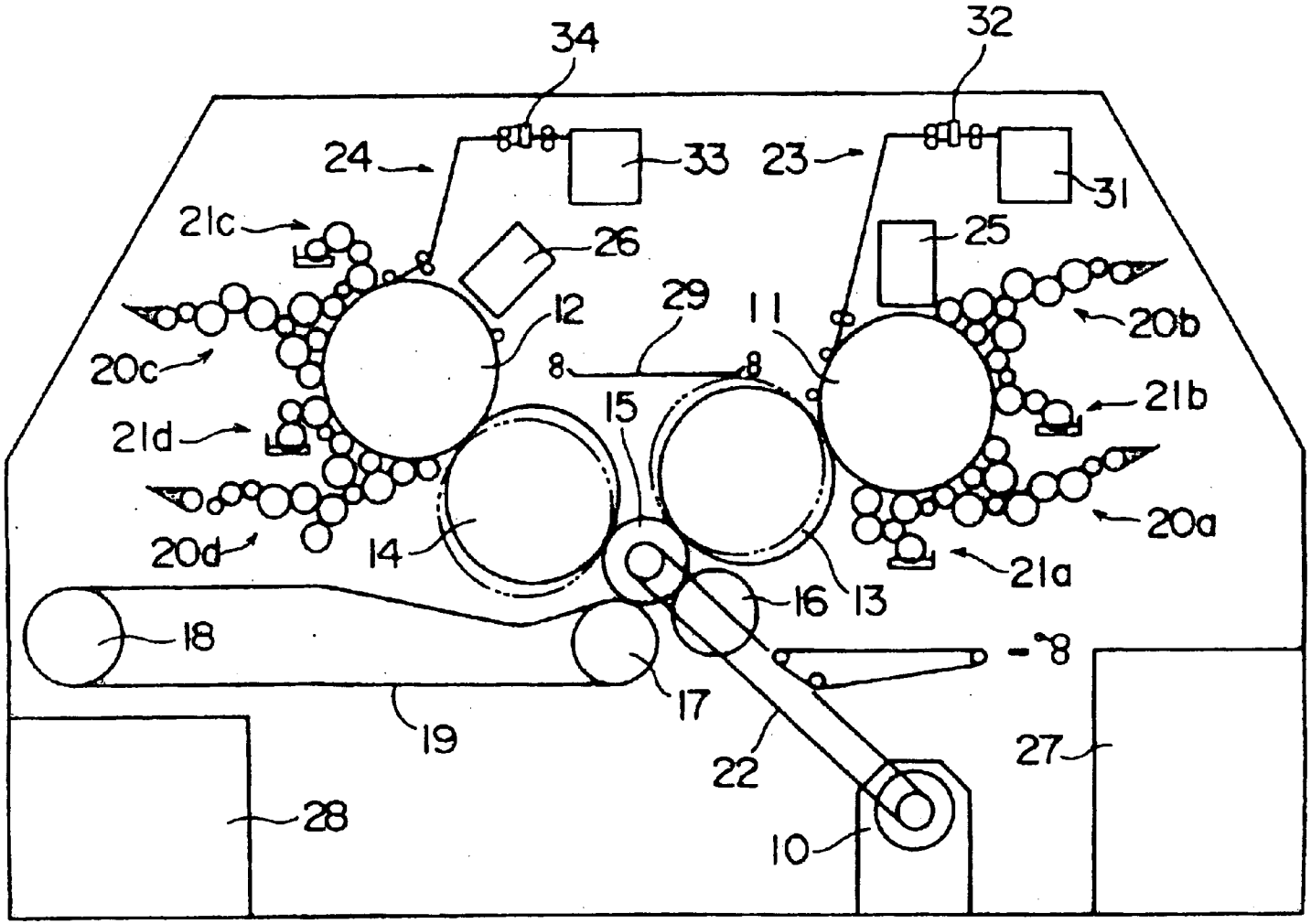
FIG. 1 is a schematic view of a printing machine according to this invention.

Embodiments of this invention will be described hereinafter with reference to the drawings. FIG. 1 is a schematic view of a printing machine according to the invention.

This printing machine makes printing plates by recording and developing images on blank plates mounted on first and second plate cylinders 11 and 12, feeds inks to the plates having the images recorded thereon, and transfers the inks from the plates through first and second blanket cylinders 13 and 14 to printing paper mounted on an impression cylinder 15, thereby printing the images on the printing paper.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The machine further includes a paper feed cylinder 16 for transferring printing paper supplied from a paper magazine 27 to the impression cylinder 15, a paper discharge cylinder 17 with chains 19 wound thereon and on a sprocket 18 for discharging printed paper from the impression cylinder 15 to a paper discharge station 28.

The impression cylinder 15 contactable by the first and second blanket cylinders 13 and 14 has half the diameter of the first and second plate cylinders 11 and 12 and the first and second blanket cylinders 13 and 14. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper magazine 27. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having grippers arranged thereon. When the impression cylinder 15 transfers the printing paper to the discharge cylinder 17, one of the grippers of the discharge cylinder 17 holds the forward end of the printing paper having been held by the gripper of the impression cylinder 15. With movement of the chains 19, the printing paper is discharged to the paper discharge station 28.

The impression cylinder 15 is connected to a drive motor 10 through a belt 22. The impression cylinder 15, feed cylinder 16, discharge cylinder 17 and first and second blanket cylinders 13 and 14 are connected to one another through gears attached to ends thereof, respectively. Further, the first blanket cylinder 13 is connected to the first plate cylinder 11, and the second blanket cylinder 14 to the second plate cylinder 12 by gears attached to ends thereof, respectively, when the first and second blanket cylinders 13 and 14 are in printing positions described hereinafter. Thus, the drive motor 10 rotates the feed cylinder 16, impression cylinder 15, discharge cylinder 17, first and second blanket cylinders 13 and 14, and first and second plate cylinders 11 and 12 synchronously with one another.

The first plate cylinder 11 has, arranged therearound, an ink feeder 20*a* for feeding black ink (K), for example, to a plate, an ink feeder 20*b* for feeding magenta ink (M) to a different plate, and dampening water feeders 21*a* and 21*b* for feeding dampening water to the plates. The second plate cylinder 12 has, arranged therearound, an ink feeder 20*c* for feeding cyan ink (C) to a plate, an ink feeder 20*d* for feeding yellow ink (Y) to a different plate, and dampening water feeders 21*c* and 21*d* for feeding dampening water to the plates.

Further, the first and second plate cylinders 11 and 12 have, arranged therearound, a plate feeder 23 for feeding plates to the periphery of the first plate cylinder 11, a plate feeder 24 for feeding plates to the periphery of the second plate cylinder 12, an image recorder 25 for recording images on the plates mounted peripherally of the first plate cylinder 11, an image recorder 26 for recording images on the plates mounted peripherally of the second plate cylinder 12, and a plate discharger 29 common to the first and second plate cylinders 11 and 12.

Each of the image recorders 25 and 26 includes a recording head moving mechanism for moving a recording head to a retreat position. The recording head moving mechanism will be described in detail hereinafter.

In the printing machine having the above construction, a printing plate drawn from a supply cassette 31 in the plate feeder 23 is cut to a predetermined size by a cutter 32. A forward end of the printing plate cut into sheet form is guided by guide rollers and a guide member, and clamped by a clamping jaw on the first plate cylinder 11. Then, the first plate cylinder 11 is rotated by a motor, whereby the printing plate is wound peripherally of the first plate cylinder 11. The rear end of the printing plate is clamped by a different clamping jaw. While, in this state, the first plate cylinder 11 is rotated at low speed by the motor, the image recorder 25 irradiates the surface of the plate mounted peripherally of the first plate cylinder 11 with a modulated laser beam for recording an image thereon.

Similarly, a printing plate drawn from a supply cassette 33 in the plate feeder 24 is cut to a predetermined size by a cutter 34. A forward end of the printing plate cut into sheet form is guided by guide rollers and a guide member, and clamped by a clamping jaw on the second plate cylinder 12. Then, the second plate cylinder 12 is rotated by a motor, whereby the printing plate is wound peripherally of the second plate cylinder 12. The rear end of the printing plate is clamped by a different clamping jaw. While, in this state, the second plate cylinder 12 is rotated at low speed by the motor, the image recorder 26 irradiates the surface of the plate mounted peripherally of the second plate cylinder 12 with a modulated laser beam for recording an image thereon.

The first plate cylinder 11 holds two printing plates mounted peripherally thereof, one for printing in the black ink and the other in the magenta ink. These two printing plates are arranged in evenly separated positions, i.e. in positions separated from each other by 180 degrees. The image recorder 25 records images on these printing plates. Similarly, the second plate cylinder 12 holds two printing plates mounted peripherally thereof, one for printing in the cyan ink and the other in the yellow ink. These two printing plates also are arranged in evenly separated positions. The image recorder 26 records images on these printing plates to complete a platemaking process.

The platemaking process is followed by a printing process for printing the printing paper with the plates mounted on the first and second plate cylinders 11 and 12. The printing process is carried out as follows.

First, each dampening water feeder 21*a*, 21*b*, 21*c*, 21*d* and each ink feeder 20*a*,20*b*,20*c*, 20*d* are placed in contact with only a corresponding one of the plates mounted on the first and second plate cylinders 11 and 12. Consequently, dampening water and inks are fed to the plates from the corresponding water feeders 21*a*, 21*b*, 21*c*, 21*d* and ink feeders 20*a*, 20*b*, 20*c*, 20*d*, respectively. The inks fed to the plates are transferred to the first and second blanket cylinders 13 and 14, respectively.

Then, the printing paper is fed to the paper feed cylinder 16. The printing paper is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 to the paper discharge station 28 to be discharged therein.

Upon completion of the printing process, the plates used in the printing are discharged to the plate discharger 29. Then, the first and second blanket cylinders 13 and 14 are cleaned by a blanket cleaning unit, not shown, to complete the printing process.

In such a printing machine as described above, where the recording heads of the image recorders 25 and 26 are arranged close to the first and second plate cylinders 11 and 12 at a printing time, mists and particles of the inks, water, paper and so on floating in the printing machine tend to adhere to the recording heads. In this printing machine, therefore, the recording head moving mechanism moves each recording head to a retreat position at a printing time.

Figure 2:
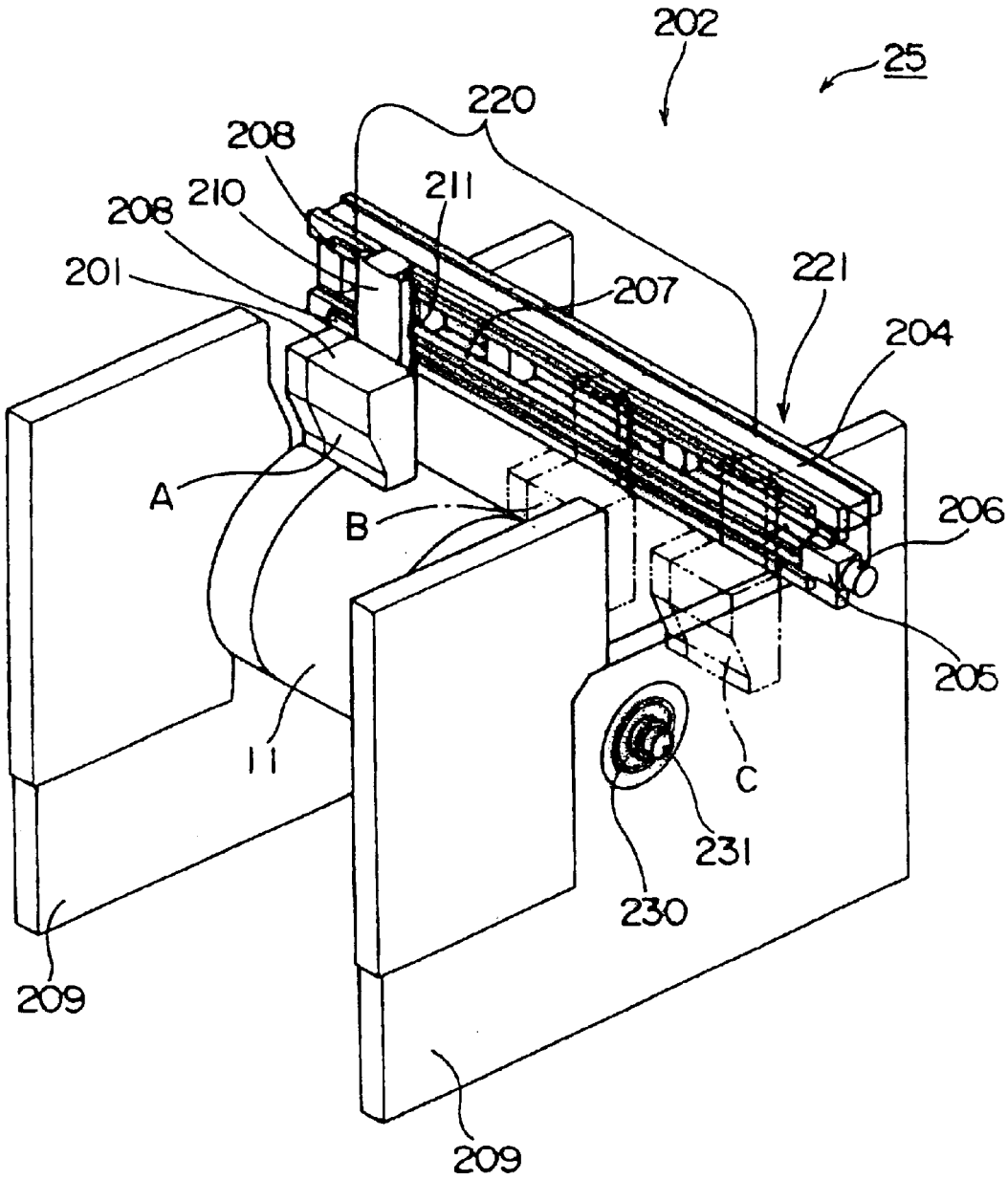
FIG. 2 is a perspective view of a principal portion of an image recorder in a first embodiment of this invention.

The construction of the image recorders 25 and 26 will be described hereinafter. FIG. 2 is a perspective view showing a principal portion of the image recorder 25 in the printing machine according to a first embodiment of this invention.

The image recorder 26 has the same construction as the image recorder 25, and will not particularly be described.

The image recorder 25 includes a recording head 201 and a recording head moving mechanism 202. The recording head moving mechanism 202 has a support member 204 extending between a pair of side plates 209 rotatably supporting the first plate cylinder 11 through bearings 230, a pair of guide rails 208 fixed to a side surface of the support member 204, and a ball screw 207 extending parallel to the guide rails 208. The pair of guide rails 208 and the ball screw 207 are parallel to an axis 231 of the first plate cylinder 11. The ball screw 207 is connected through a speed reducer 205 to a motor 206 fixed an end of the support member 204. The ball screw 207 is meshed with a nut 211 attached to a support plate 210 supporting the recording head 201. Thus, the motor 206 is operable to rotate the ball screw 207, thereby to move the recording head 201 parallel to the axis 231 of the first plate cylinder 11.

In time of recording an image, this recording head moving mechanism 202 moves the recording head 201 at constant speed through a moving region 220 between a recording start position A shown in solid lines in FIG. 2 and a recording finish positions B shown in phantom lines to record the image on the printing plate mounted peripherally of the plate cylinder 11. After recording the image, the recording head 201 is moved to a retreat position 221 shown in phantom lines C in FIG. 2, which is displaced sideways from the moving region 220. The recording head 201 is kept on standby in the retreat position 221 until a next image recording time.

By keeping the recording head 201 on standby in the retreat position 221 at a printing time, the above printing machine minimizes the chance of the recording head 201 being contaminated by the inks, water, paper particles and so on dispersed in the printing machine.

Figure 3:
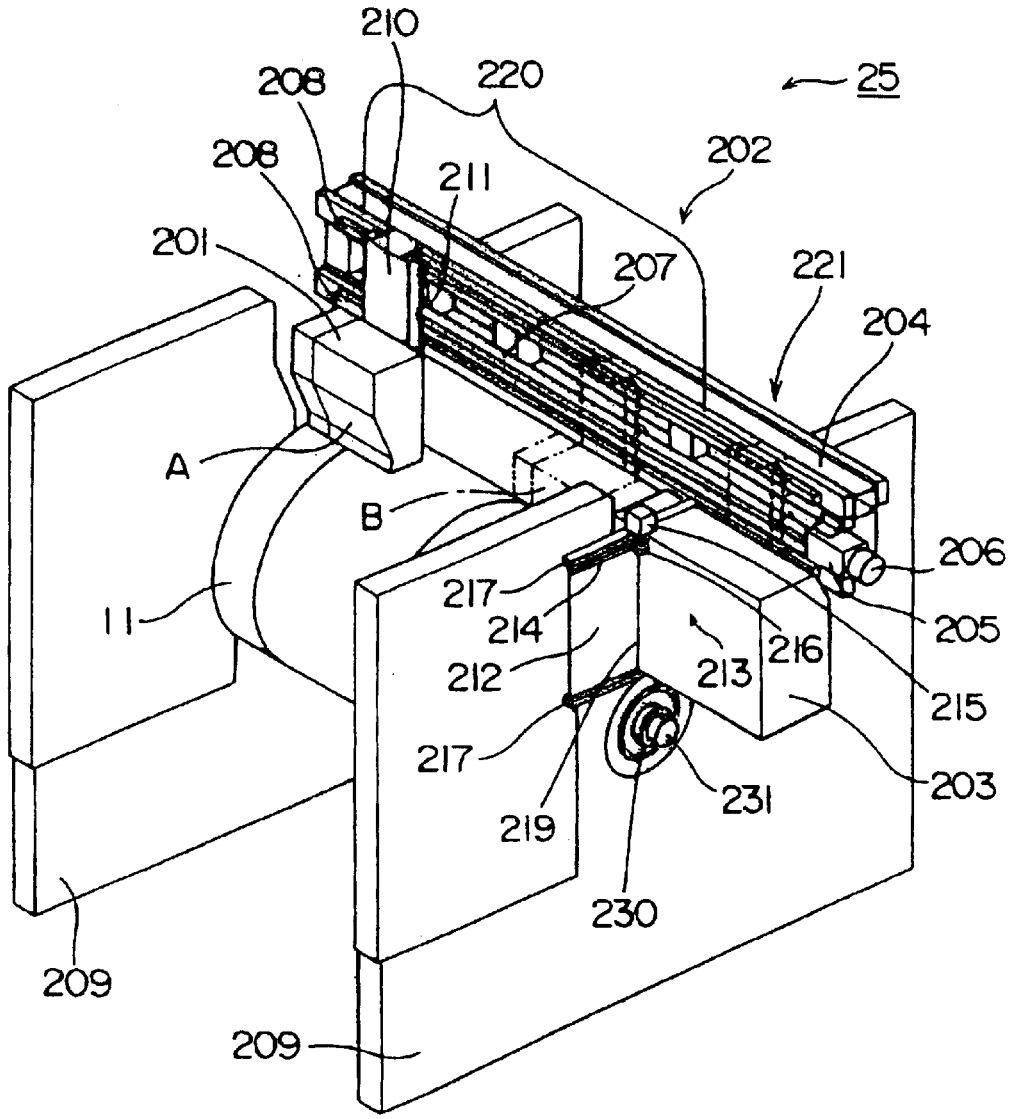
FIG. 3 is a perspective view of a principal portion of an image recorder in a second embodiment of this invention.

Other embodiments of this invention will be described next. FIG. 3 is a perspective view showing a principal portion of an image recorder 25 in the printing machine according to a second embodiment of this invention. In the following description, like reference numerals are used to identify like parts which are the same as in the first embodiment and will not particularly be described again.

The image recorder 25 in the second embodiment, as does the image recorder 25 in the first embodiment, includes a recording head 201 and a recording head moving mechanism 202.

The image recorder 25 in the second embodiment further includes a chamber 203 for enclosing the recording head 201 moved to the same retreat position as in the first embodiment, and defining an opening, not shown, opposed to the moving region 220 for passage of the recording head 201, a shielding door 212 for opening and closing the opening 212, and a door moving mechanism 213 for moving the shielding door 212 between opening and closing positions. The chamber 203 is disposed on an extension of the direction of movement of the recording head 201, and laterally outwardly of one side plate 209.

The door moving mechanism 213 includes a pair of guide rails 217 attached to the side plate 209 adjacent the chamber 203, a rack 214 fixed to a side surface of the shielding door 212, and a pinion 216 engaged with the rack 214. The pair of guide rails 217 extend perpendicular to the direction of movement of the recording head 201 and parallel to the rack 214. The pinion 216 is attached to a rotary shaft of a motor 215. With the door moving mechanism 213 having the above construction, the pinion 216 is rotatable by the motor 215 to move the rack 214 engaged with the pinion 216, thereby to move the shielding door 212 in directions perpendicular to the direction of movement of the recording head 201.

This printing machine can further reduce the chance of the recording head 201 being contaminated by the inks, water, paper particles and so on dispersed in the printing machine, with the shielding door 212 closing the opening formed for passage of the recording head 201 at least when the recording head 201 is in the retreat position 221.

Figure 4:
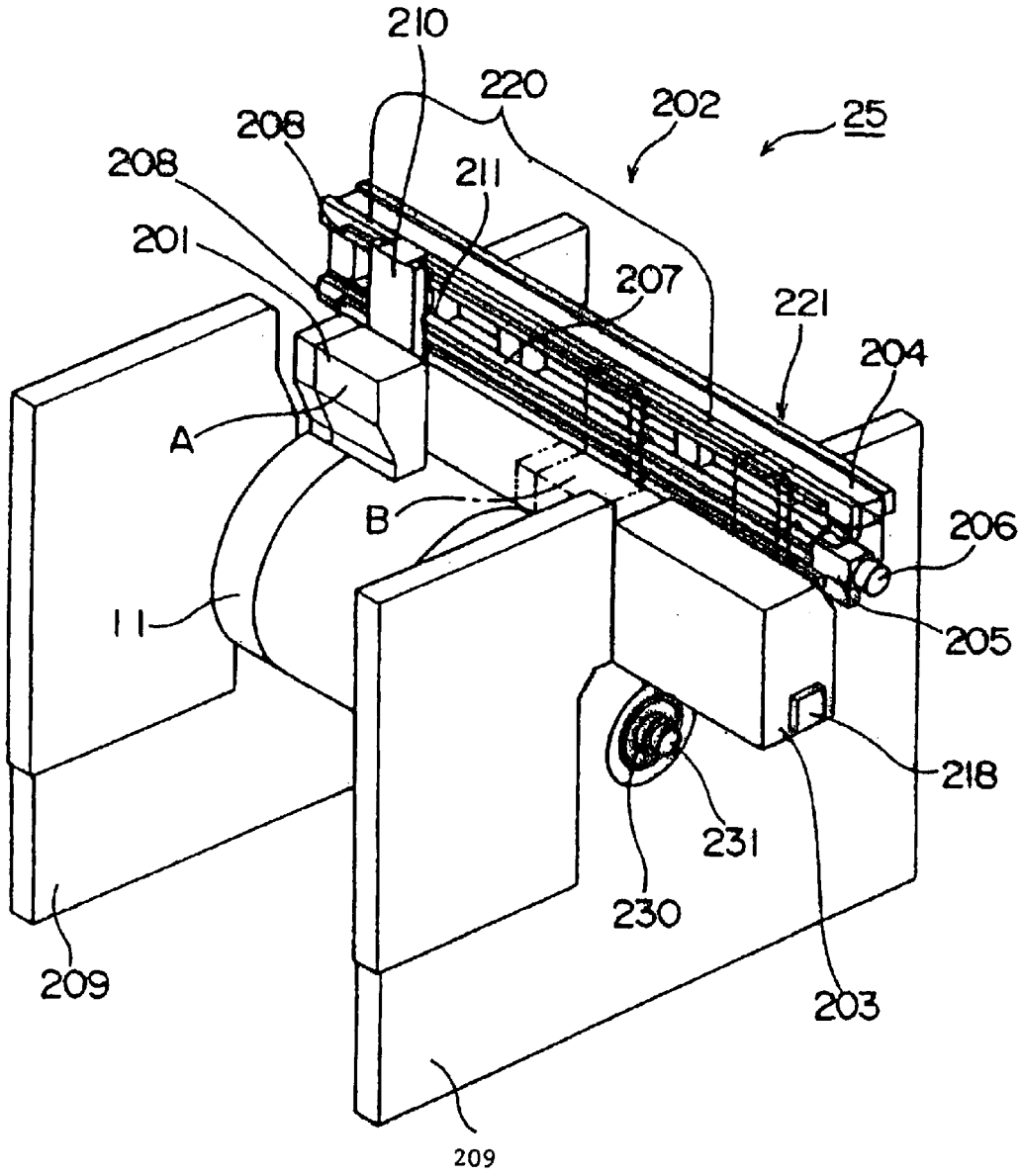
FIG. 4 is a perspective view of a principal portion of an image recorder in a third embodiment of this invention.

FIG. 4 is a perspective view showing a principal portion of an image recorder 25 in the printing machine according to a third embodiment of this invention.

The image recorder 25 in the third embodiment, as does the image recorder 25 in the second embodiment, includes a recording head 201, a recording head moving mechanism 202 and a chamber 203.

However, the image recorder 25 in the third embodiment does not include the shielding door 212 or door moving mechanism 213. The chamber 203 of the image recorder 25 has a gas intake fan 218. The fan 218 draws air as a gas from outside the printing machine into the chamber 203, and feeds the air from the chamber 203 to the interior of the printing machine through the opening for the opening for passage of the recording head 201. Thus, air currents are formed to flow from outside to inside of the printing machine.

Preferably, the fan 218 draws fresh air from outside the printing machine through an air duct not shown. The fan 218 need not be driven at all times, but will serve the purpose if driven at least during a printing operation.

In this printing machine, the air currents from outside to inside of the printing machine prevent the inks, water, paper particles and so on dispersed in the printing machine from entering the retreat position 221. This feature can further reduce the chance of the printing machine being contaminated by the inks, water, paper particles and so on.

Figure 5:
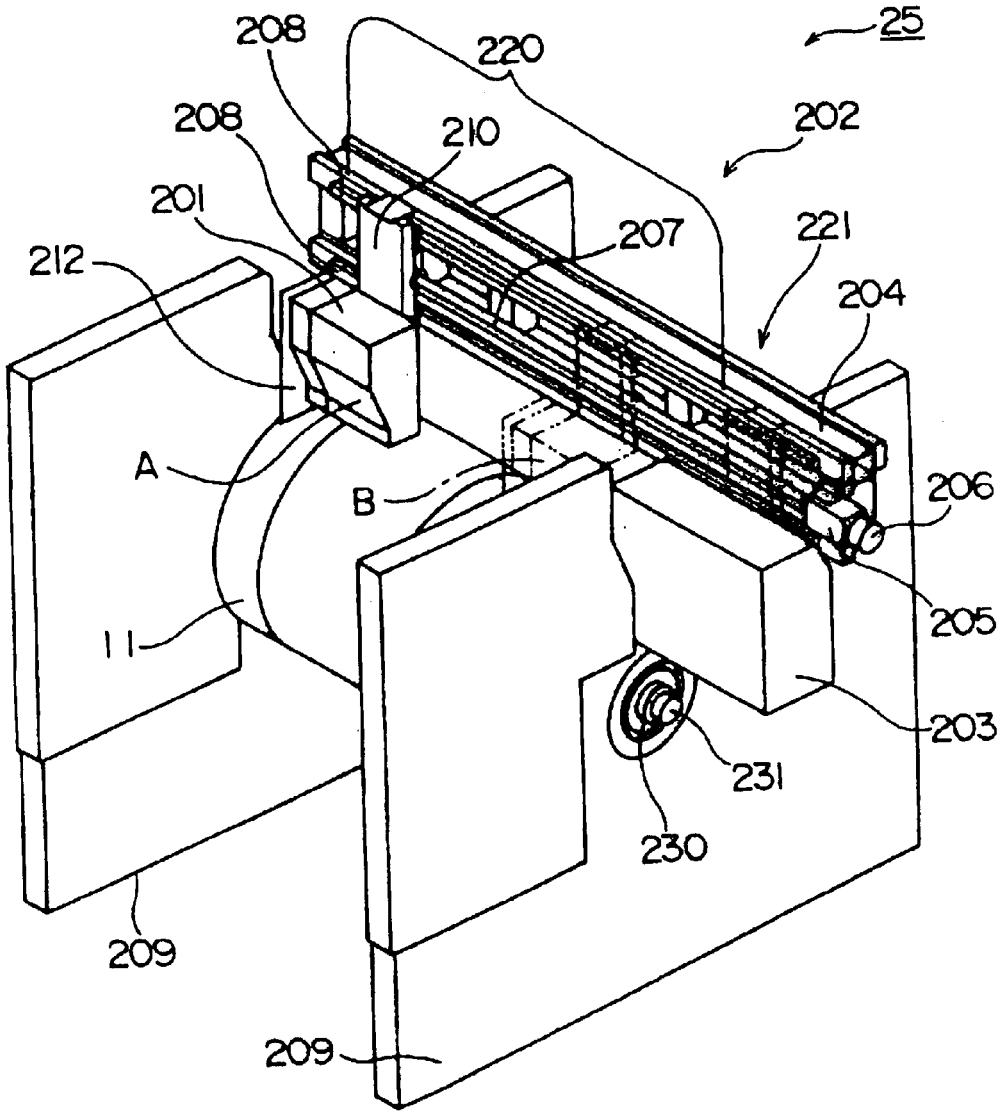
FIG. 5 is a perspective view of a principal portion of an image recorder in a fourth embodiment of this invention.
Figure 6:
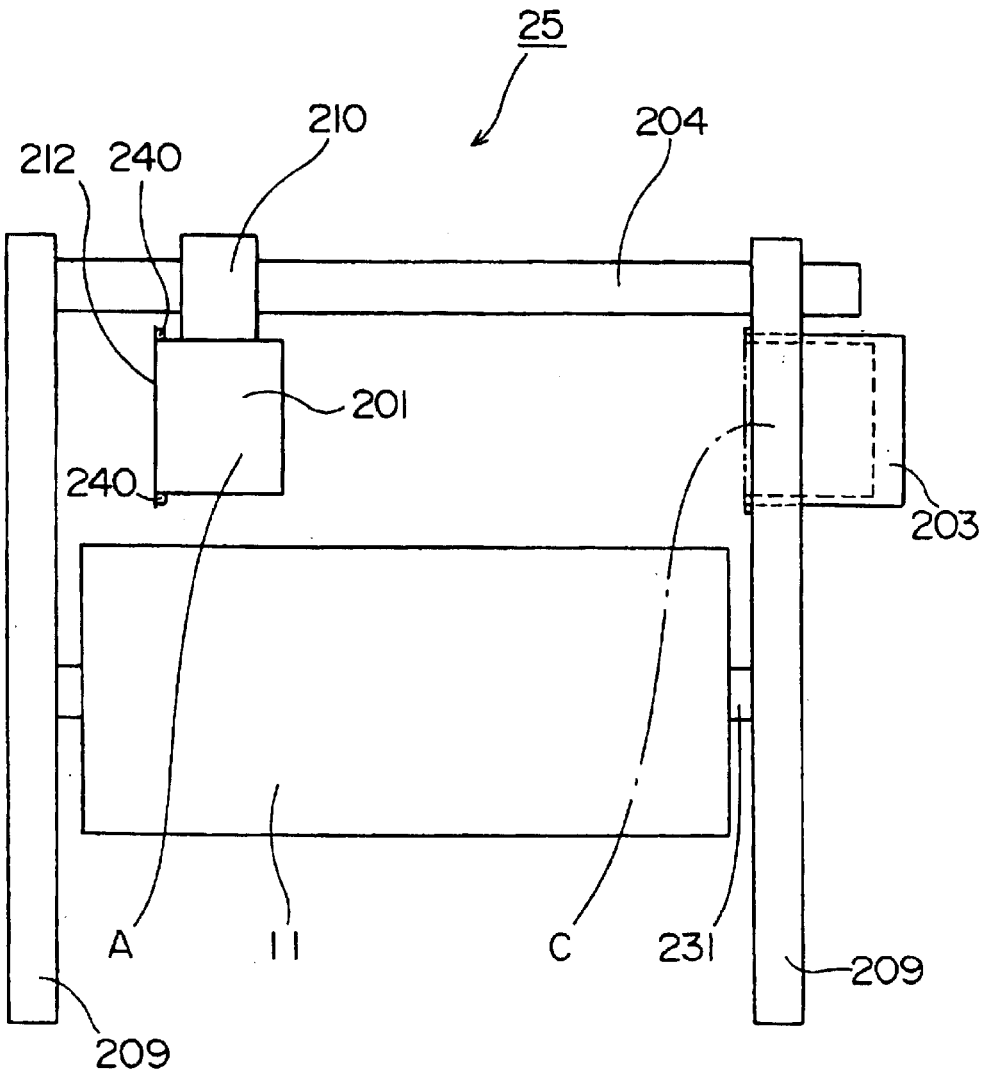
FIG. 6 is a schematic side view showing movement of a recording head of the image recorder in the fourth embodiment.

FIG. 5 is a perspective view showing a principal portion of an image recorder 25 in the printing machine according to a fourth embodiment of this invention. FIG. 6 is a schematic side view showing movement of a recording head 201 of the image recorder 25 in the fourth embodiment.

The image recorder 25 in the fourth embodiment, as does the image recorder 25 in the second embodiment, includes a recording head 201, a recording head moving mechanism 202 and a chamber 203.

However, the image recorder 25 in the fourth embodiment does not include the door moving mechanism 213. The recording head 201 has a shielding door 212 attached to a position thereof opposed to the moving region 220 when the recording head 201 is in the chamber 203. Thus, the shielding door 212 is movable with the recording head 201 to close the opening for passage of the recording head 201 when the recording head 201 is in the chamber 203.

As shown in FIG. 6, the shielding door 212 has shock absorbing elements 240 such as sponges attached to positions thereof opposed to the recording head 201. Even when the shielding door 212 collides with the side plate 209 or chamber 203 in closing the passage opening, the impact of collision is absorbed to avoid damage to the machine.

The above printing machine can close the opening for passage of the recording head 201, without providing the door moving mechanism 213, when the recording head 201 in the retreat position 221. This simple construction effectively reduces the chance of the recording head 201 being contaminated by the inks, water, paper particles and so on dispersed in the printing machine.

Figure 7:
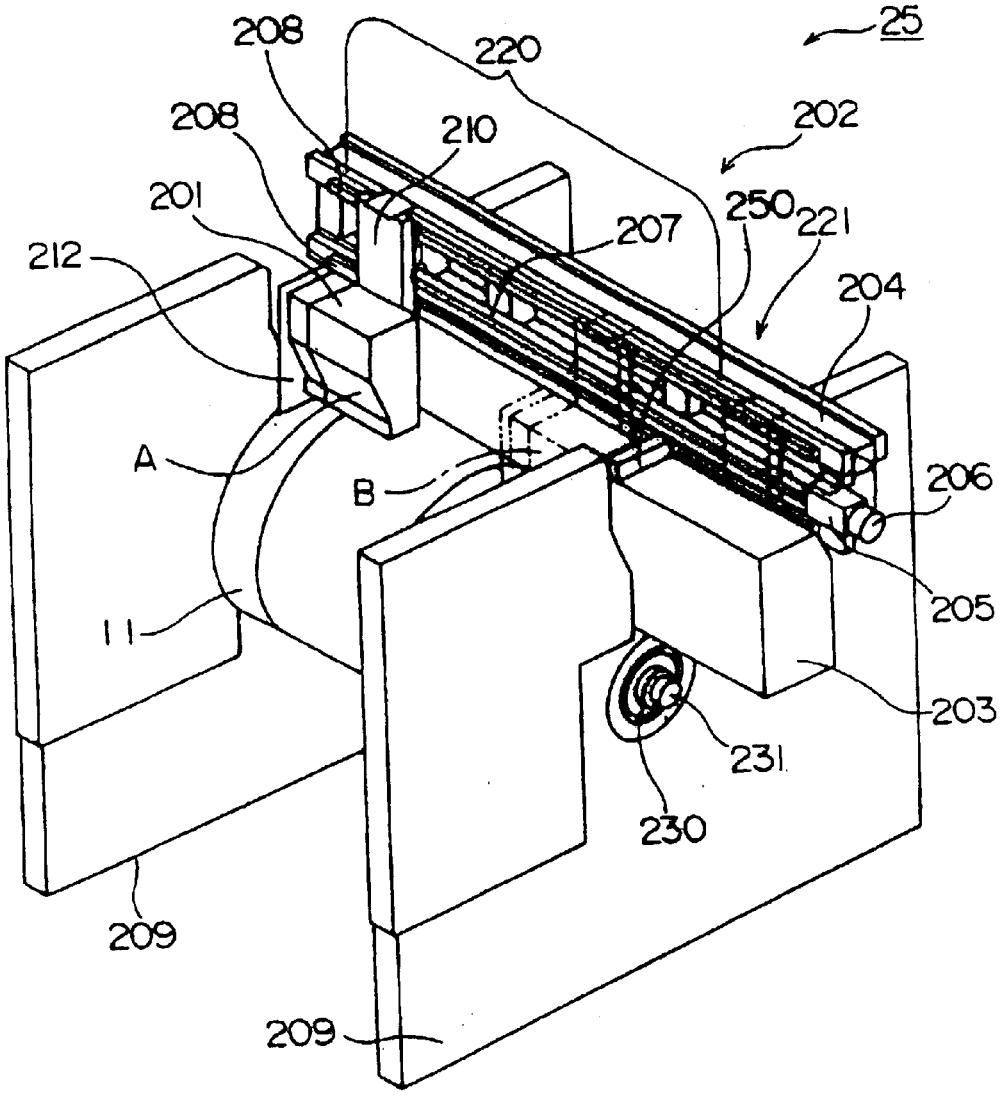
FIG. 7 is a perspective view of a principal portion of an image recorder in a fifth embodiment of this invention.
Figure 8:
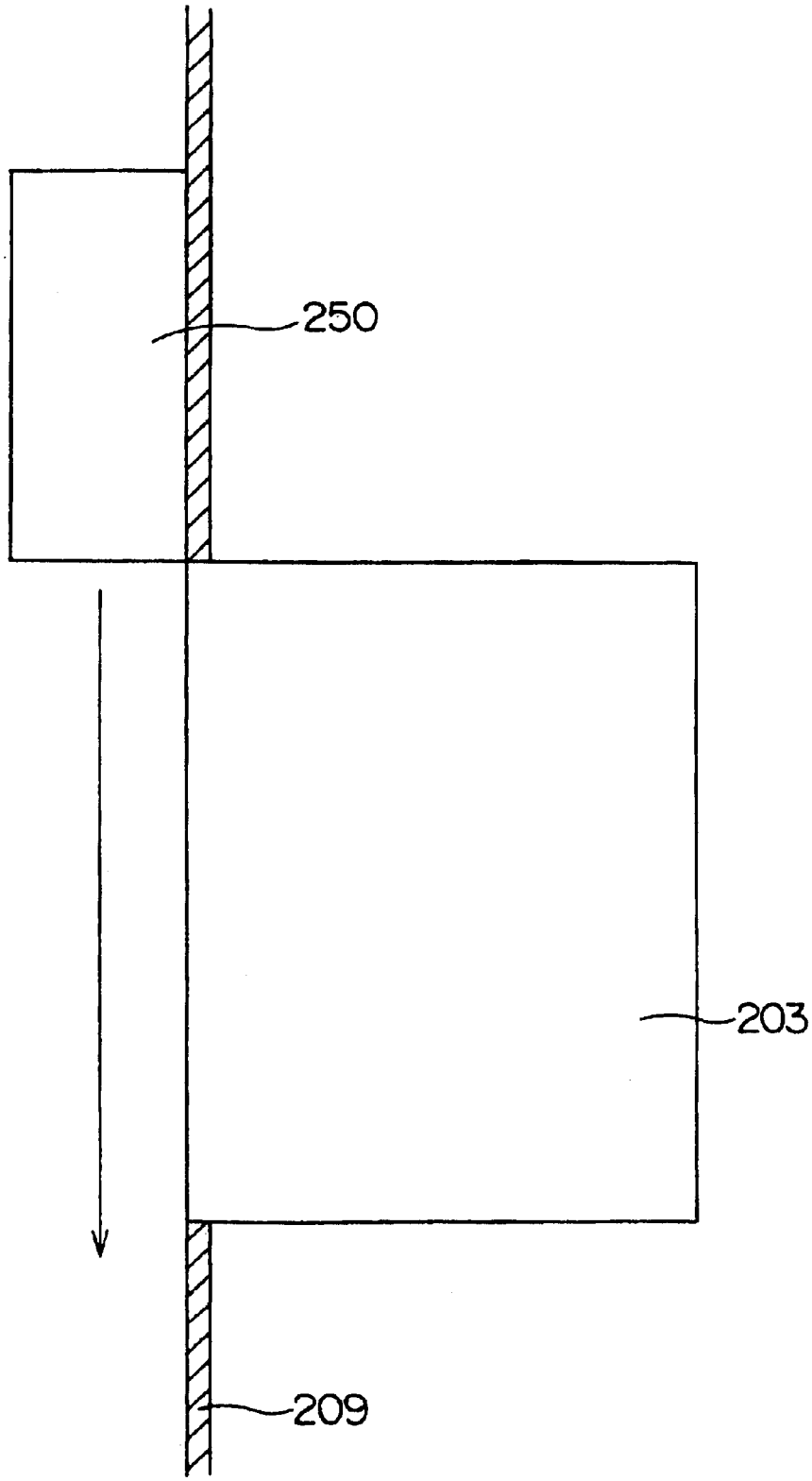
FIG. 8 is a schematic sectional view showing a chamber interior of the image recorder in the fifth embodiment.

FIG. 7 is a perspective view of a principal portion of an image recorder 25 in the printing machine according to a fifth embodiment of this invention. FIG. 8 is a schematic sectional view showing a chamber interior of the image recorder 25 in the fifth embodiment.

The image recorder 25 in the fifth embodiment, as does the image recorder 25 in the second embodiment, includes a recording head 201, a recording head moving mechanism 202 and a chamber 203.

However, the image recorder 25 in the fifth embodiment does not include the door moving mechanism 213. A gas jet nozzle 250 is connected to an air compressor not shown, to form an air curtain (a flow in the direction of an arrow shown in FIG. 8) along an opening of the chamber 203 as a barrier between the retreat position 221 and moving regions 220. The gas flow delivered from the gas jet nozzle 250 prevents movement of the inks, water, paper particles and so on between the retreat position 221 and moving regions 220.

The above printing machine can block flow of the inks, water, paper particles and so on between the retreat position 221 and moving regions 220, without providing the door moving mechanism 213. This simple construction effectively reduces the chance of the recording head 201 in the retreat position 221 being contaminated by the inks, water, paper particles and so on dispersed in the printing machine.

In the foregoing embodiments, one of the side plates 209 rotatably supporting the plate cylinder 11 is used as a shielding plate. Instead, a shielding plate may be provided separately from the side plate.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-326208 filed in the Japanese Patent Office on Nov. 11, 2002, and Japanese Patent Application No. 2003-198246 filed in the Japanese Patent Office on Jul. 17, 2003, entire disclosure of which is incorporated herein by reference.

What is claimed is:

1. A printing machine for recording an image on a printing plate, and printing the image by using the printing plate with the image recorded thereon, comprising:

a plate cylinder for supporting a printing plate as mounted peripherally thereof; an image recorder having a recording head movable along a surface of said plate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a shielding plate disposed between said moving region and said retreat position, and defining an opening for allowing passage of said recording head; and a gas jet nozzle for forming an air curtain along said opening as a barrier between said retreat position and said moving region.

2. A printing machine for recording an image on a printing plate, and printing the image by using the printing plate with the image recorded thereon, comprising:

a plate cylinder for supporting a printing plate as mounted peripherally thereof:

an image recorder having a recording head movable along a surface of said plate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a shielding plate disposed between said moving region and said retreat position, and defining an opening for allowing passage of said recording head; and a shielding door for opening and closing said opening of said shielding plate.

3. A printing machine as defined in claim 2, wherein said shielding door is attached to a position of said recording head opposed to said moving region when said recording head is in said retreat position, for closing said opening of said shielding plate when said recording head is in said retreat position.

4. A printing machine for recording an image on a printing plate, and printing the image by using the printing plate with the image recorded thereon, comprising:

a plate cylinder for supporting a printing plate as mounted peripherally thereof;

an image recorder having a recording head movable along a surface of said plate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a shielding plate disposed between said moving region and said retreat position, and defining an opening for allowing passage of said recording head; and gas flow forming means for forming a gas flow directed from said retreat position toward said moving region.

5. A printing machine as defined in claim 4, wherein said gas flow forming means includes a chamber for enclosing said recording head moved to said retreat position, said chamber defining an opening opposed to said moving region for allowing passage of said recording head, and a fan for drawing a gas from outside said printing machine into said chamber.

6. A printing machine for recording an image on a printing plate, and printing the image by using the printing plate with the image recorded thereon, comprising:

a plate cylinder for supporting a printing plate as mounted peripherally thereof;

an image recorder having a recording head movable along a surface of said plate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a chamber for enclosing said recording head moved to said retreat position, said chamber defining an opening opposed to said moving region for allowing passage of said recording head; and a gas jet nozzle for forming an air curtain along said opening as a barrier between inside of said chamber and outside of said chamber.

7. A printing machine for recording an image on a printing plate, and printing the image by using the printing plate with the image recorded thereon, comprising;

a plate cylinder for supporting a printing plate as mounted peripherally thereof;

an image recorder having a recording head movable along a surface of said plate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a chamber for enclosing said recording head moved to said retreat position, said chamber defining an opening opposed to said moving region for allowing passage of said recording head; and a shielding door for opening and closing said opening of said chamber.

8. A printing machine as defined in claim 7, wherein said shielding door is attached to a position of said recording head opposed to said moving region when said recording head is in said retreat position, for closing said opening of said chamber when said recording head is in said chamber.

9. A printing machine for recording an image on a printing plate, and printing the image by using the printing plate with the image recorded thereon, comprising;

a plate cylinder for supporting a printing plate as mounted peripherally thereof;

an image recorder having a recording head movable along a surface of said elate cylinder in a direction parallel to an axis of rotation of said plate cylinder for recording an image on said printing plate mounted peripherally of said plate cylinder;

an ink feeder for feeding ink to said printing plate with the image recorded thereon mounted peripherally of said plate cylinder;

a printing means for printing an image on a printing sheet by using the printing plate with an ink fed;

retreat moving means, operable at a printing time, for moving said recording head to a retreat position sideways from a moving region where said recording head is moved at an image-recording time;

a chamber for enclosing said recording head moved to said retreat position, said chamber defining an opening opposed to said moving region for allowing passage of said recording head; and gas flow forming means for forming a gas flow directed from inside of said chamber toward outside of said chamber.

* * * * *